US005661851A

United States Patent [19]

Sanchez

[11] Patent Number: 5,661,851

[45] Date of Patent: Sep. 2, 1997

[54] DISPOSABLE BIB

[76] Inventor: Omar Sanchez, 9310 Fontainebleau Blvd., Miami, Fla. 33172

[21] Appl. No.: 626,052

[22] Filed: Apr. 1, 1996

[51] Int. Cl.[6] ..... A41B 13/10; A41D 13/04

[52] U.S. Cl. ..... 2/49.4; 2/49.1; 2/48; 2/46

[58] Field of Search ..... 2/46, 48, 49.1, 2/49.2, 49.3, 49.4, 49.5, 50, 51, 52, 174, 104, 105, 106, 113, 114, 115

[56] References Cited

U.S. PATENT DOCUMENTS

| | | | |
|---|---|---|---|
| 2,262,010 | 11/1941 | Kuehne | 2/48 X |
| 2,501,010 | 3/1950 | Seidenbaum | 2/52 X |
| 3,857,116 | 12/1974 | Meeker | 2/50 |
| 3,916,447 | 11/1975 | Thompson | 2/46 |
| 4,423,523 | 1/1984 | Bodner et al. | 2/48 |
| 5,432,952 | 7/1995 | Tate | 2/46 X |
| 5,490,289 | 2/1996 | Lehrer | 2/49.4 |
| 5,530,968 | 7/1996 | Crockett | 2/46 |

FOREIGN PATENT DOCUMENTS

| | | | |
|---|---|---|---|
| 600109 | 6/1960 | Canada | 2/49.2 |
| 749066 | 5/1956 | United Kingdom | 2/49.5 |
| 818997 | 8/1959 | United Kingdom | 2/52 |

*Primary Examiner*—Jeanette E. Chapman
*Attorney, Agent, or Firm*—McAulay Fisher Nissen Goldberg & Kiel, LLP

[57] ABSTRACT

A disposable bib is disclosed formed of multiple plies of material. The front central portion of the bib is made of a water absorbent ply material while the remaining portions are made of a water repellent ply material. The bib includes an attachable and detachable neck panel for positioning the bib snugly around the neck of the wearer to protect the wearer's underclothes from food and liquid spills.

9 Claims, 2 Drawing Sheets

DISPOSABLE BIB

BACKGROUND OF THE INVENTION

1. Field of the Invention

This invention relates generally to a disposable bib and, in particular, to an adjustably worn bib for infants which is constructed of water repellent material having a front main panel of water absorbent material.

2. Description of the Prior Art

Bibs typically are worn by infants at feeding time to protect their underclothes from food and liquid spills. One type of known bib is constructed of cloth material with strings for tying it around the wearer's neck. A cloth bib, while absorbent, is not disposable. It has to be washed after use and is costly to replace.

A second type of known bib is made of paper also having tie-on strings. This type of bib is relatively inexpensive and is intended for disposal after a single use. However, this bib is not terribly absorbent and offers little protection to the undergarment.

Yet a third type of known bib is made of plastic also having tie-on strings. This type of bib is intended for disposal after a single use. While the cost for such bib is not excessive, it is not absorbent. Accordingly, liquid spills typically roll off the bib onto the wearer's clothes.

Another drawback of the aforesaid bibs is that the tie-on strings often become loose when the bibs are in use. This causes the bibs to move or slide downward away from the wearer's neck thereby permitting food or liquid spills to fall behind the bib and onto the undergarment.

The present invention, as hereinafter described, improves on these known bibs by a construction which includes both water repellent material and water absorbent material combined in a unitary construction securely fastened around the neck of the wearer to provide optimum protection to the wearer's undergarments.

SUMMARY OF THE INVENTION

The disposable bib of the present invention preferably is constructed of three plies of material. The first ply is foldable and water repellent, and is formed having a main panel and a neck panel. The neck panel extends from the main panel to define a neck receiving zone.

The second ply also is foldable but is made of water absorbent material. The second ply is disposed to overlie and extend across a substantial portion of the upper surface of the main panel of the first ply.

The third ply, similar to the first ply, is foldable and water repellent. This ply has an outer configuration substantially corresponding to the configuration of the main panel of the first ply. The third ply also has an enlarged opening which defines inner peripheral edges of the ply. This third ply is positioned to overlie and be attached to the first ply with the water absorbent second ply exposed through the enlarged opening of the third ply. In assembly, the inner peripheral edges of the third ply overlie and are attached to marginal edge portions of the water absorbent second ply to maintain the second ply sandwiched between the first and third plies.

The neck panel of the first ply has an attachable and detachable segment which overlies and removably engages with an upper outer surface portion of the third ply to permit attaching and detaching of the bib snugly around the neck of the wearer.

BRIEF DESCRIPTION OF THE DRAWINGS

For a more complete understanding of the invention and the various features and advantages thereof, reference is made to the following detailed description taken in conjunction with the accompanying drawings in which.

DESCRIPTION OF THE PREFERRED EMBODIMENTS

Figure 1:
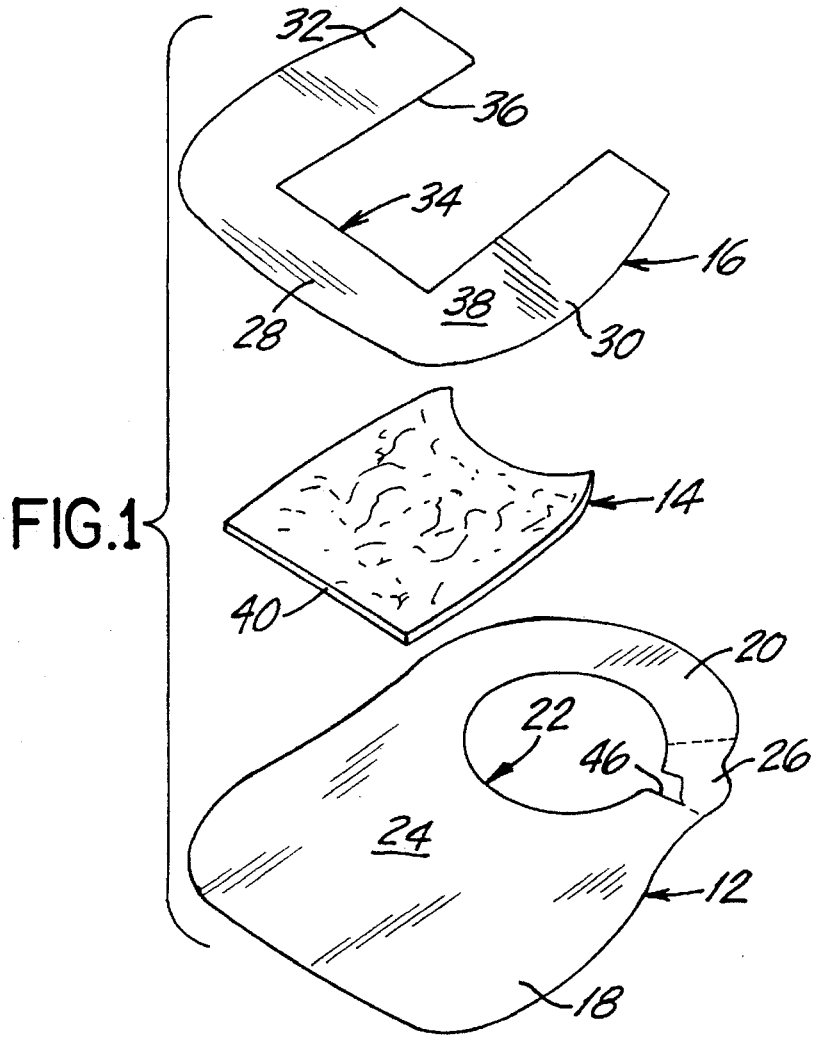
FIG. 1 is an exploded perspective view of the component plies which make up the disposable bib of the present invention.
Figure 4:
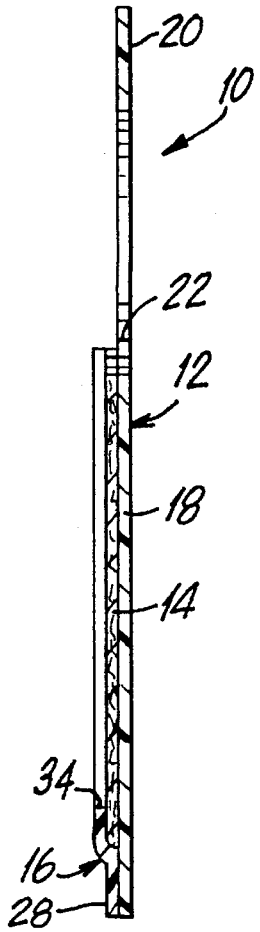
FIG. 4 is a sectional view taken along line 4—4 of FIG. 2.

Referring to the drawings, and particularly to FIGS. 1–4, there is shown a disposable bib 10 constructed in accordance with the present invention. Bib 10 is constructed of a water repellent foldable first ply 12, a water absorbent foldable second ply 14, and a water repellent foldable third ply 16.

First ply 12 is made of plastic such as cellophane or the like, and is formed having a main panel 18 and a neck panel 20 which extends from main panel 18 to define a neck receiving open zone 22. Main portion 18 has an upper surface 24. Neck panel 20 has a segment 26 which permits the attaching and detaching of bib 10 around the neck of a wearer as hereinafter described. The thickness of first ply 12 is approximately one mil.

Second ply 14 is absorbent and can be made of a water insoluble cellulosic polymer of the kind disclosed in U.S. Pat. No. 3,826,711 issued Jul. 30, 1974, entitle Sheeted Cellulose Derivative Fibers. The thickness of second ply 14 is approximately fifty (50) mils when dry. Second ply 14 is positioned to overlie and extend across a substantial portion of the upper surface 24 of main panel 18 of first ply 12.

Third ply 16 is made of plastic such as cellophane, and has an overall U-shape configuration which includes a lower segment 28 and two side segments 30 and 32, respectively. Side segments 30 and 32 are connected to and extend from lower segment 28, which segments collectively provide an enlarged opening 34 defined by inner peripheral edges 36. Segments 28, 30, and 32 each have an upper surface 38. The outer configuration of third ply 16 substantially corresponds to the configuration of main panel 18 of first ply 12. The thickness of third ply 16 is approximately one mil.

Third ply 16 is positioned to overlie and be attached to first ply 12, such as by heat seal, to provide a water repellent border along three edges of bib 10. The arrangement is such that water absorbent second ply 14 is sandwiched or captured between first ply 10 and third ply 16, and is exposed through the enlarged opening 34 of third ply 16. In order to secure second ply 14 in place, the inner peripheral edges 36 of third ply 16 overlie and are attached to marginal edge portions 40 of second ply 14, such as by heat seal, adhesive or the like.

Figure 2:
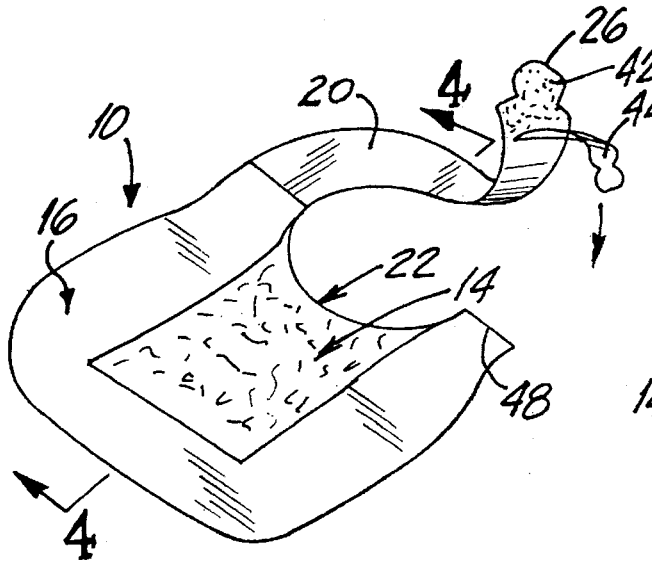
FIG. 2 is a perspective view of the assembled bib of FIG. 1.
Figure 3:
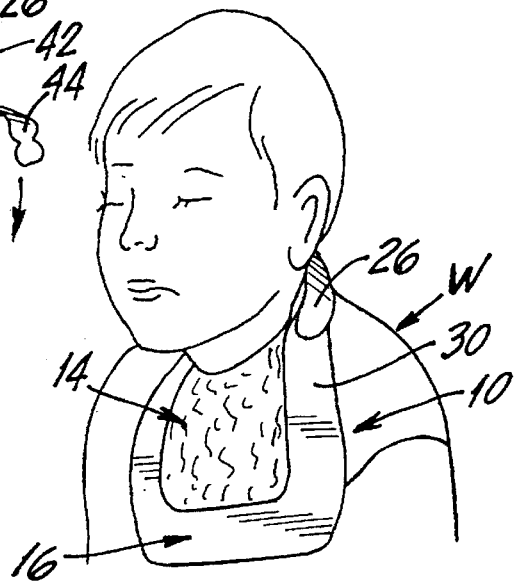
FIG. 3 is a perspective view of the assembled bib secured around the neck of a wearer.

FIGS. 2 and 3 show the manner for securing bib 10 snugly in place around a wearer's neck. Segment 26 of first ply 12 is formed having a layer of adhesive 42 which is protected prior to use of bib 10 by a peel away sheet 44. Segment 26 initially in connected to an upper edge 46 of main panel 18 along a perforated tear line 48, as shown in FIG. 1. When the bib is to be put in use, segment 26 is separated from main panel 18 and peel away sheet 44 is removed, as shown in FIG. 2. Bib 10 is then filled snugly around the neck of wearer "W", as shown in FIG. 3.

It will be appreciated that the snug fit securement of bib 10 is accomplished by adjustably positioning segment 26 to overlie a region of the upper surface 38 of side segment 30 of third ply 16. One can remove the bib simply by lifting up and detaching segment 26 from third ply 16. The present means for securing the bib in place, when in use, is far more effective than the use of tie-on strings mentioned in connection with the prior art. As can be seen in FIG. 3, the bib is not likely to fall or slide downward away from the wearer's neck.

In the preferred embodiment, the first ply 12 and the third ply 16 are each a cellophane ply approximately one (1) mil thick. Also, while it is envisioned that third ply 16 would take on the construction as shown, it is possible that ply 16, similar to first ply 12, could have a neck panel disposed to overlie and be affixed to neck panel 20 of first ply 12.

Still further, it is envisioned that third ply 16 may be omitted entirely leaving a construction covered only by first ply 12 and second ply 14. In such instance, water absorbent second ply 14 would be attached to the main panel 18 of first ply 12 by a known bonding technique such as heat seal, adhesive or the like. The first ply would extend beyond the periphery of the second ply to provide a water repellent border along three edges of the bib. Regardless of whether the finalized construction is a composite of two or three plies, it will be appreciated that the water absorbent second ply is suitably positioned to receive food and/or liquid spills from the wearer's mouth where it will be absorbed. Most of the spills will fall in this region of the bib. Those spills of a lesser degree which reach the water repellent region on the outer surfaces of the bib can be quickly and easily wiped dry. The overall configuration reduces significantly the likelihood of soiling the wearer's undergarments.

The terms "water repellent" and "water absorbent" are understood to mean materials that either repel or absorb, as the case may be, not only water but other liquids as well, such as juice, tea and the like. Also, while the bib is primarily intended for use with infants, it will find comparable use for persons of advanced years or the handicapped.

Figure 5:
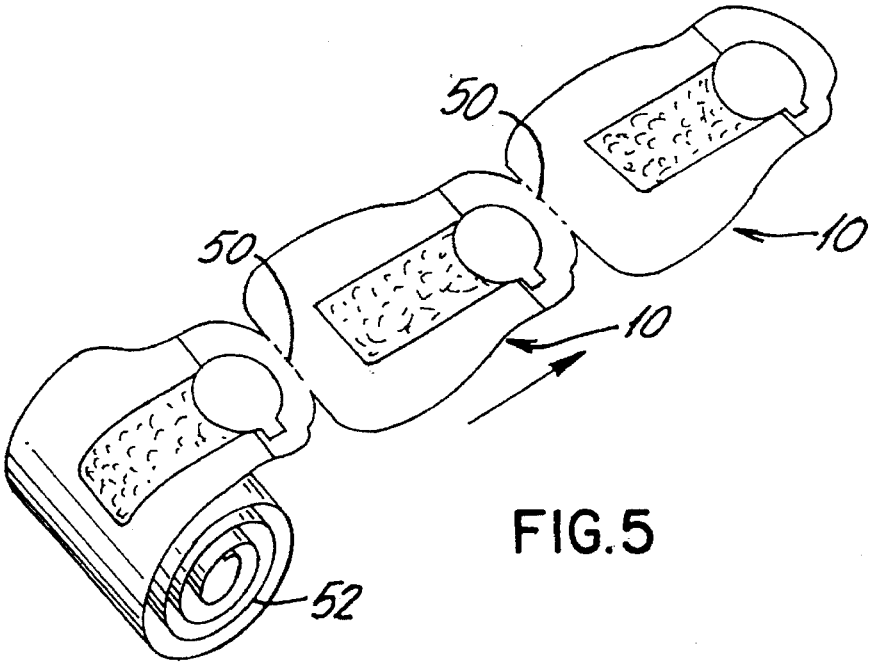
FIG. 5 is a perspective view showing a plurality of bibs connected in edge to edge relation to one another and rolled into a roll.

FIG. 5 shows how a plurality of such bibs 10 can be manufactured and packaged in a roll. Specifically, adjacent bibs 10 are shown as connected in edge to edge relation to one another along a perforated line 50 and rolled into roll 52. The perforated line 50 facilitates individual removal of a bib for use as desired.

Figure 6:
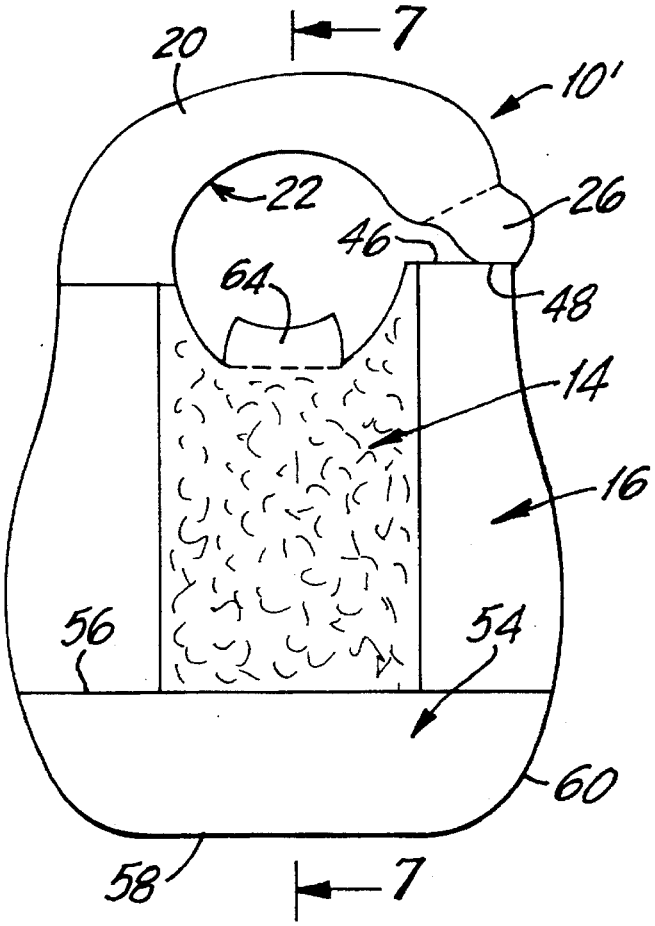
FIG. 6 is a front elevational view of a bib which is an alterative embodiment of the invention.
Figure 7:
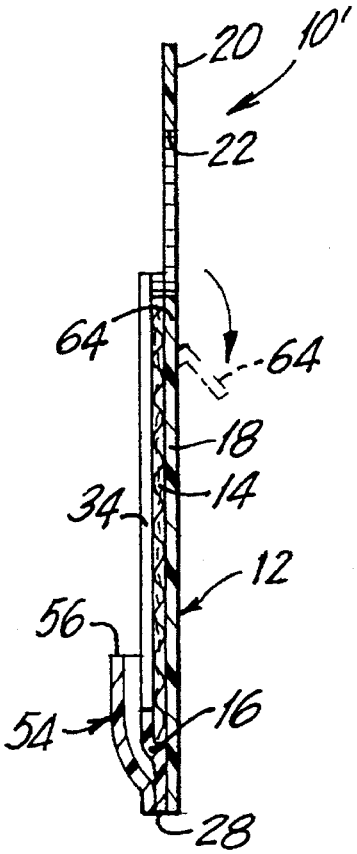
FIG. 7 is a sectional view taken along line 7—7 of FIG. 6.

FIGS. 6 and 7 show an alternative embodiment wherein bib 10' includes a water repellent pocket panel 54 of foldable material having an upper edge 56, a lower edge 58 and opposed side edges 60 and 62, respectively. The lower edge 58 and side edges 60, 62 of panel 54 overlie and are attached to the lower surface 28 and outer side surfaces 30, 32 of third panel 16. The upper edge 56 is left free to provide access to the pocket whereby food and liquid droppings which are not absorbed by second panel 14 will be caught in pocket panel 54.

The embodiment of FIGS. 6 and 7 also includes a flap segment 64 extending from the main panel 18 of first ply 12 into the region of the neck receiving open zone 22. Flap 64 is intended to be folded over the neckline of the wearer's undergarment to assist in keeping bib 10' close to the wearer's chest, and may provide added comfort when the bib is in use. Aside from pocket panel 54 and flap segment 64 the remaining structure of bib 10' corresponds to that of bib 10.

While preferred embodiments of the invention have been shown and described in detail, it will be apparent to those skilled in the art that various changes and modifications may be made without departing from the basic principles of the invention embraced by the following claims.

What is claimed is:

1. A disposable bib comprising:

a water repellent foldable first ply;

said first ply having a main panel and a neck panel extending from said main panel to define a neck receiving open zone;

said neck panel having an attachable and detachable segment to permit attaching and detaching said bib around the neck of the wearer;

a water absorbent foldable second ply overlying and extending across at least a substantial portion of the upper surface of said main panel of said first ply;

a water repellent third ply;

said third ply having an outer configuration substantially corresponding to the configuration of said main panel of said first ply, and having an enlarged opening which defines inner peripheral edges of said third ply;

said third ply overlying and being attached to said first ply to provide a water repellent border along three edges of said bib, with said water absorbent second ply exposed through said enlarged opening of said third ply; and said inner peripheral edges of said third ply overlying and being attached to marginal edge portions of said water absorbent second ply.

2. The disposable bib of claim 1, wherein:

said neck panel segment is adjustably positioned to overlie an upper outer surface portion of said third ply; and adhesive means on at least one of the overlapping facing surfaces of said neck panel and said third ply for securing said bib snugly in place.

3. The disposable bib of claim 2, further comprising:

a peel away protective sheet covering said adhesive means, said sheet disposed to be removed from said adhesive means when said bib is in use.

4. The disposable bib of claim 1, wherein:

said water absorbent second ply is a water insoluble cellulosic polymer.

5. The disposable bib of claim 4, wherein:

said water absorbent second ply is approximately fifty (50) mils (1.25 mm) thick when dry.

6. The disposable bib of claim 1, wherein:

said first ply and said third ply are each a cellophane ply approximately one (1) mil thick.

7. The disposable bib of claim 1, further comprising:

a water repellent pocket panel of foldable material having an upper edge, a lower edge, and opposed side edges;

said lower edge and said opposed side edges of said pocket panel being attached to respective portions of the lower and side outer surfaces of said third panel.

8. The disposable bib of claim 1, wherein:

said first ply has a foldable flap segment connected to the upper edge of said main panel and extending into said neck receiving open zone, said flap disposed to be folded over the neckline of the wearer when said bib is in use.

9. A disposable bib roll comprising:

a plurality of bibs having the characteristics recited in claim 1:

adjacent ones of said plurality of bibs being connected in edge to edge relation to one another and rolled into a roll;

the connection of adjacent bibs being along a perforated line to facilitate individual removal.

* * * * *